US010730671B2

(12) United States Patent
Drosos et al.

(10) Patent No.: US 10,730,671 B2
(45) Date of Patent: Aug. 4, 2020

(54) CHILD RESISTANT PACKAGING

(71) Applicant: JohnsByrne Company, Niles, IL (US)

(72) Inventors: Michael Drosos, Norridge, IL (US); John Cunningham, Grayslake, IL (US)

(73) Assignee: JohnsByrne Company, Niles, IL (US)

( * ) Notice: Subject to any disclaimer, the term of this patent is extended or adjusted under 35 U.S.C. 154(b) by 0 days.

(21) Appl. No.: 15/915,024

(22) Filed: Mar. 7, 2018

(65) Prior Publication Data

US 2018/0257827 A1 Sep. 13, 2018

Related U.S. Application Data

(60) Provisional application No. 62/467,897, filed on Mar. 7, 2017, provisional application No. 62/505,253, filed on May 12, 2017.

(51) Int. Cl.
*B65D 50/06* (2006.01)
*B65D 5/38* (2006.01)

(52) U.S. Cl.
CPC ..... *B65D 50/066* (2013.01); *B65D 5/38* (2013.01); *B65D 2215/04* (2013.01); *B65D 2585/56* (2013.01)

(58) Field of Classification Search
CPC ..... B65D 50/066; B65D 5/38; B65D 2215/02
USPC ..... 206/1.5
See application file for complete search history.

(56) References Cited

U.S. PATENT DOCUMENTS 401,210 A 4/1889 Reed
3,888,350 A 6/1975 Horvath
4,192,422 A 3/1980 Kotyuk
4,365,739 A 12/1982 Webinger
4,428,307 A 1/1984 Vasquez
4,485,915 A 12/1984 Berghahn
4,810,200 A 3/1989 Sakamoto
5,082,137 A 1/1992 Weinstein
5,275,291 A 1/1994 Sledge
5,353,956 A 10/1994 Wilson
(Continued)

FOREIGN PATENT DOCUMENTS

GB 2488451 8/2012
JP 2017007691 1/2017
(Continued)

OTHER PUBLICATIONS

Origin Pharma Packaging, "SmartX | blister packaging | child resistant tablet carton | tamper evident", Published on May 31, 2017, Relevant Information: 0:53 minute, URL <https://www.youtube.com/watch?v=jNz35iYCk2o>.
(Continued)

*Primary Examiner* — Anthony D Stashick
*Assistant Examiner* — L Kmet
(74) *Attorney, Agent, or Firm* — Valauskas Corder LLC

(57) ABSTRACT

Child resistant packaging for storing medicine or medicinal compositions that frustrates or prevents a child's attempts to access the contents while permitting an adult to easily open the packaging through a series of movements or steps in coordination or combination to readily access the contents. The child resistant packaging includes a housing component and an insert component that is configured to slideably interact with an interior space of the housing component between a locked configuration and an unlocked configuration.

20 Claims, 7 Drawing Sheets

(56) References Cited

U.S. PATENT DOCUMENTS

| | | | | |
|---|---|---|---|---|
| 5,816,441 | A | 10/1998 | Farside | |
| 6,009,069 | A | 12/1999 | Yamashita et al. | |
| 6,036,018 | A | 3/2000 | Harrold | |
| 6,047,829 | A | 4/2000 | Johnstone et al. | |
| 6,230,893 | B1 | 5/2001 | Karow | |
| 6,386,209 | B1 | 5/2002 | Yuhara et al. | |
| 6,460,693 | B1 | 10/2002 | Harrold | |
| 6,641,031 | B2 | 11/2003 | Evans et al. | |
| 6,675,972 | B2 | 1/2004 | Patterson | |
| 6,874,636 | B2 | 4/2005 | Paliotta et al. | |
| 6,988,618 | B2 | 1/2006 | DeJonge | |
| 7,090,079 | B2 | 8/2006 | Ehrlund | |
| 7,150,355 | B2 | 12/2006 | Coe et al. | |
| 7,216,776 | B2 | 5/2007 | Geraldi | |
| 7,367,449 | B2 | 5/2008 | Kaminski et al. | |
| 7,389,875 | B2 | 6/2008 | Sandberg et al. | |
| 7,464,819 | B2 | 12/2008 | Maietta | |
| 7,588,149 | B2 | 9/2009 | Geraldi | |
| 7,591,372 | B2 | 9/2009 | Geraldi et al. | |
| 7,617,935 | B2 | 11/2009 | Reilley et al. | |
| 7,658,287 | B2 | 2/2010 | Hession | |
| 7,793,784 | B2 | 9/2010 | Nivala | |
| 7,802,677 | B2 | 9/2010 | Williams | |
| 7,806,270 | B2 | 10/2010 | Seibert et al. | |
| 7,845,496 | B2 | 12/2010 | Hession | |
| 7,900,772 | B2 | 3/2011 | Sack et al. | |
| 7,967,144 | B2 | 6/2011 | Sack et al. | |
| 8,011,512 | B2 | 9/2011 | Brollier et al. | |
| 8,066,121 | B2 | 11/2011 | Sack et al. | |
| 8,333,280 | B2 | 12/2012 | Le | |
| 8,365,916 | B2 | 2/2013 | Gelardi | |
| 8,490,794 | B2 | 7/2013 | Kalin et al. | |
| 8,499,936 | B2 * | 8/2013 | Albrecht | B65D 83/0463 206/528 |
| 8,602,218 | B2 | 12/2013 | Grosskopf | |
| 8,672,134 | B2 | 3/2014 | Sprada et al. | |
| 8,794,482 | B2 | 8/2014 | Sack et al. | |
| 9,174,780 | B2 | 11/2015 | Gelardi et al. | |
| 9,180,068 | B2 | 11/2015 | Loftin | |
| 9,260,229 | B1 | 2/2016 | Ongchangco | |
| 9,326,913 | B2 | 5/2016 | Weston et al. | |
| 9,376,246 | B2 | 6/2016 | Jones et al. | |
| 9,387,149 | B2 | 7/2016 | Jones et al. | |
| 9,452,877 | B2 | 9/2016 | Grosskopf | |
| 9,475,605 | B2 | 10/2016 | Everett | |
| 2004/0045858 | A1 | 3/2004 | Harrold | |
| 2004/0099565 | A1 | 5/2004 | Dehlin | |
| 2004/0262189 | A1 | 12/2004 | Fraser et al. | |
| 2007/0045150 | A1 | 3/2007 | Huffer et al. | |
| 2007/0251983 | A1 | 11/2007 | Freeze | |
| 2008/0251410 | A1 | 10/2008 | Gelardi | |
| 2008/0283434 | A1 | 11/2008 | Gelardi | |
| 2009/0045078 | A1 | 2/2009 | Gelardi et al. | |
| 2009/0184022 | A1 | 7/2009 | Coe et al. | |
| 2009/0266837 | A1 | 10/2009 | Gelardi et al. | |
| 2009/0301924 | A1 | 12/2009 | Rondeau | |
| 2010/0200581 | A1 | 8/2010 | Maltz | |
| 2011/0168712 | A1 | 7/2011 | Bailey et al. | |
| 2011/0204074 | A1 | 8/2011 | Gelardi et al. | |
| 2011/0226765 | A1 | 9/2011 | Gelardi | |
| 2012/0160726 | A1 | 6/2012 | Gelardi | |
| 2012/0181204 | A1 | 7/2012 | Bogdziewicz et al. | |
| 2012/0199581 | A1 * | 8/2012 | Matsuba | B65D 83/0463 220/23.87 |
| 2013/0193029 | A1 | 8/2013 | Weston et al. | |
| 2014/0251842 | A1 | 9/2014 | Pipes et al. | |
| 2014/0262839 | A1 | 9/2014 | Le et al. | |
| 2016/0001937 | A1 | 1/2016 | Skinner | |
| 2016/0176617 | A1 | 6/2016 | Bolognia et al. | |
| 2016/0318651 | A1 | 11/2016 | Jones et al. | |
| 2016/0347524 | A1 | 12/2016 | Jones et al. | |
| 2017/0057688 | A1 | 3/2017 | Patwardhan et al. | |
| 2017/0081098 | A1 | 3/2017 | Vercoe et al. | |

FOREIGN PATENT DOCUMENTS

| | | |
|---|---|---|
| WO | 1996022229 | 7/1996 |
| WO | 2003010065 | 2/2003 |
| WO | 2006068602 | 6/2006 |

OTHER PUBLICATIONS

McDonald, Candide, "Ecobliss child resistant packaging", Published on May 19, 2014, Relevant Information: 0:12-0:14 minute, URL<https://www.youtube.com/watch?v=8dINtaq0yul>.

GPSolutionsUKLtd, "Dose Prompt—Visual Patient Reminder System", Published on May 17, 2013, Relevant Information: 0:18-:0:28 minute, URL<https://www.youtube.com/watch?v=q1n1uTENC4M>.

Ecobliss Group, Locked4Kids Certified Child Resistant Cartons, URL<http://www.locked4kids.com> (last visited Apr. 26, 2017).

* cited by examiner

CHILD RESISTANT PACKAGING

CROSS REFERENCE TO RELATED PATENTS

This application claims the benefit of U.S. Provisional Patent Application No. 62/467,897 filed Mar. 7, 2017 and U.S. Provisional Patent Application No. 62/505,253 filed May 12, 2017, both of which are incorporated by reference.

FIELD OF INVENTION

The invention relates generally to product packaging. More specifically, the invention relates to child resistant packaging for storing medicine or medicinal compositions. The child resistant packaging comprises a two component assembly that frustrates or prevents a child's attempts to access the contents while permitting an adult to easily open the packaging and readily access the contents.

BACKGROUND OF THE INVENTION

Child resistant packaging or CR packaging is special packaging used to reduce the risk of children accessing and ingesting hazardous materials. Current available CR packaging include features to make the opening of packaging more difficult by requiring more strength, for example, thick push-through foils, increased adhesion, greater resistance to tearing at notches, a special safety cap, and squeeze lock levers used with a zipper. Certain of these CR packaging can be problematic for adults or aged individuals.

CR packaging must meet the performance specifications outlined in 16 CFR § 1700.15 and pass testing as outlined in 16 CFR § 1700.20(a)(2)(iii). Currently, child resistant testing is performed with panels of 50 children ranging in age from 42 to 51 months. Children are instructed on how to open the package and that they may use their teeth. Eighty-percent (80%) of the child panel must be unable to open the packaging.

To determine if the CR packaging is senior-friendly, a panel of 100 senior adults ranging in age from 50-70 years are tested to open and close the CR packaging. To pass testing, ninety-percent (90%) of the senior adult panel must open and properly reclose the packaging.

CR packaging openable by applying greater force provides greater safety for children, but can present problems for aged individuals. Therefore, there is a demand for child resistant packaging that can be opened by adults including aged individuals without difficulty. The present invention satisfies this demand by providing an assembly in which an individual must perform a series of movements or steps in coordination or combination to access the package contents.

SUMMARY OF THE INVENTION

The invention is directed to a child resistant packaging for storing product to be kept out of reach by children such as medicine or medicinal compositions. The packaging includes a housing component and an insert component, each with elements that interact to form a locking mechanism. The packaging according to the invention may be certified child resistant and senior-friendly.

Both the housing component and insert component include interacting elements that form a locking mechanism. The locking mechanism enables a locked configuration and an unlocked configuration between the housing component and the insert component. When the locking mechanism is activated, the insert component cannot be moved with respect to the housing component. When the locking mechanism is deactivated, through a series of movements or steps in coordination or combination, the insert component slideably interacts with the housing component for access to a product stored within the insert component.

The locking mechanism according to the invention includes tab aperture elements, a guide aperture element, and a lip element of the housing component and tab elements and guide recess element of the insert component. In a locked configuration, the tab elements abut the lip element that obstructs movement of the insert component from the housing component. In an unlocked configuration, the tab elements are released from the lip element by way of the tab aperture elements in order to un-obstruct movement of the insert component from the housing component.

The tab aperture elements of the housing component direct a user in placing his or her fingers to apply pressure vertically to the tab elements. The guide aperture element of the housing component directs a user in positioning his or her fingers to apply pressure laterally on the guide recess element to remove a portion of the insert component from the housing component.

In certain embodiments, the packaging may include a lock flap element that forms a receptacle for receiving the tab elements to prevent the insert component from separating from the housing component while the insert component is slideably removed from the housing component.

Further embodiments of the invention may include an insert component that is reversible within the housing component. In a first configuration the locking mechanism is available for use to lock the insert component within the housing component. In the second configuration, the insert component is reversed 180 degrees such that the tab elements are not received by the receptacle. Hence, the locking mechanism is not available for use and the insert component can separate from the housing component while the insert component is removed from the housing component.

The packaging assembly may be constructed from paper, paperboard, or a paper-based material; however, any material is contemplated including polystyrene, plastic, or metal. Certain embodiments may be constructed from a laminated paper-based material. Lamination improves strength and durability of the packaging. For example, laminated material is less susceptible to deterioration from saliva.

Each component of the packaging assembly is constructed from sheets comprising a plurality of panels. Although the packaging is detailed and described with respect to a rectangular shaped configuration, any configuration is contemplated, for example square, circular, pentagonal, etc.

Certain embodiments of the invention may include a window element on the housing component and/or insert component. The window element permits viewing of the product or contents without requiring the packaging to be opened.

While the invention is susceptible to various modifications and alternative forms, specific exemplary embodiments are shown by way of example in the following drawings which are described in detail. It should be understood, however, that there is no intent to limit the invention to the particular embodiments disclosed. On the contrary, the intention is to cover all modifications, equivalents, and alternatives falling within the scope of the invention as defined by the appended claims.

BRIEF DESCRIPTION OF THE DRAWINGS

The present invention can be better understood by reading the following detailed to description of certain preferred embodiments, reference being made to the accompanying drawings in which.

DETAILED DESCRIPTION OF THE INVENTION

Figure 1:
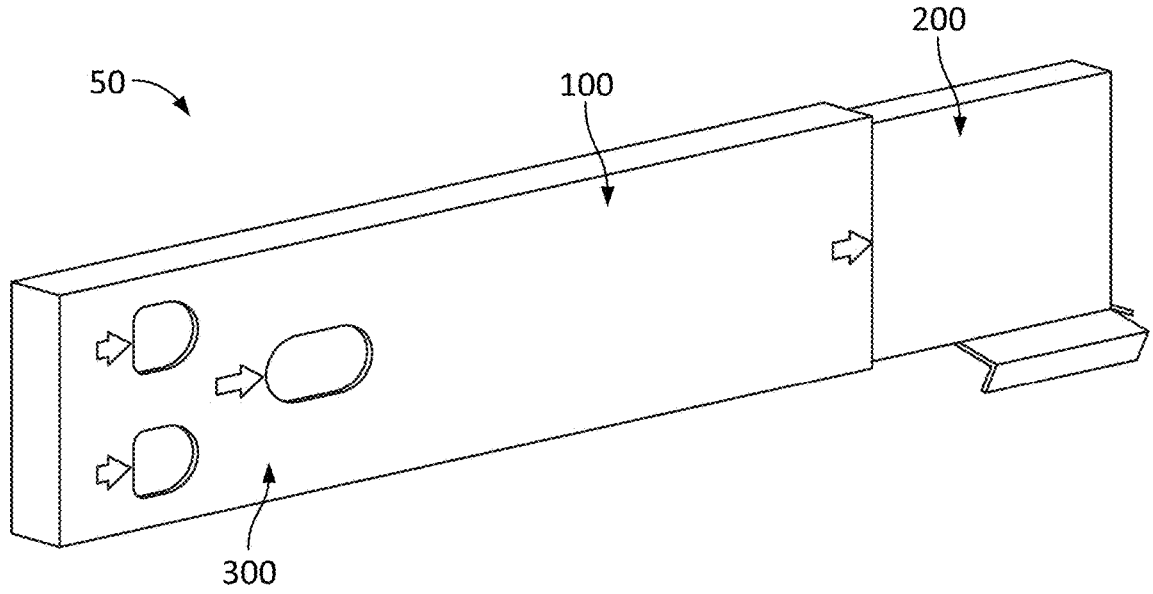
FIG. 1 illustrates a perspective view of the child resistant packaging according to the invention.

A child resistant product packaging is shown in FIG. 1. The packaging 50 includes a housing component 100 and an insert component 200. Both the housing component 100 and insert component 200 include interacting elements that form a locking mechanism 300. The locking mechanism 300 enables a locked configuration and an unlocked configuration between the housing component 100 and the insert component 200. When the locking mechanism 300 is activated, the insert component 200 cannot be moved with respect to the housing component 100. When the locking mechanism 300 is deactivated, through a series of movements or steps in coordination or combination, the insert component 200 slideably interacts with the housing component 100 for access to a product stored within the insert component 200.

Figure 2B:
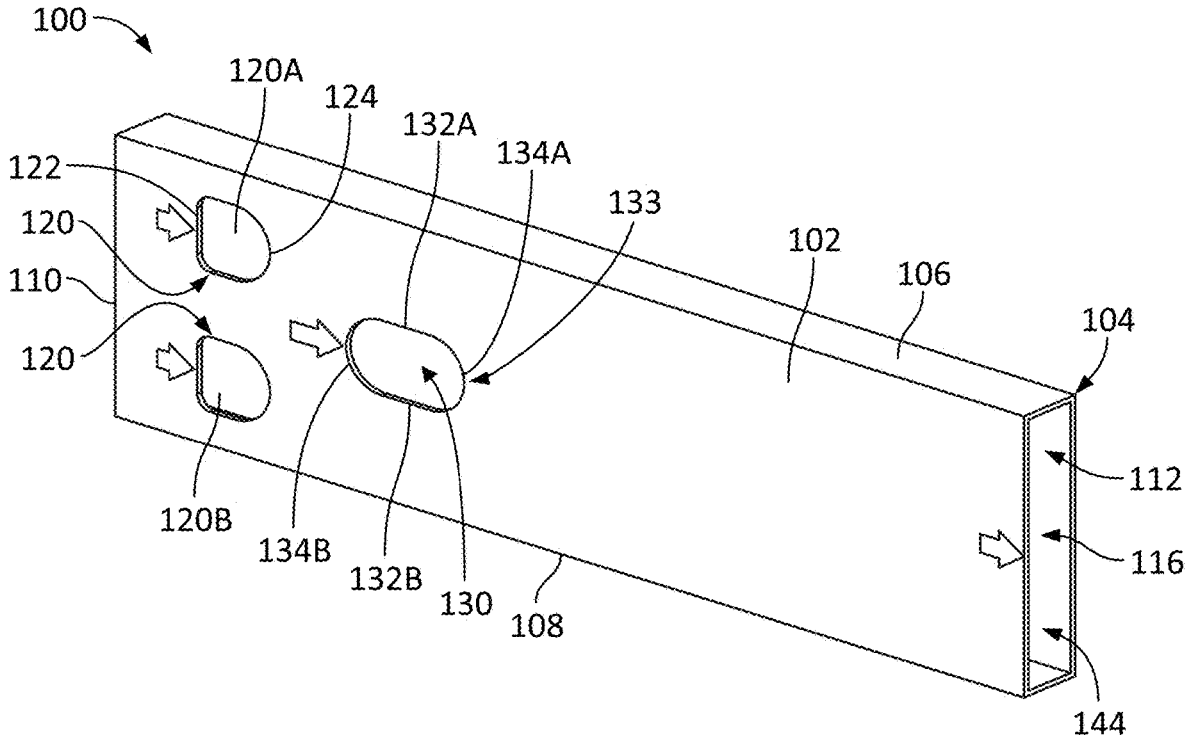
FIG. 2B illustrates a perspective view of a constructed housing component according to the invention.
Figure 2A:
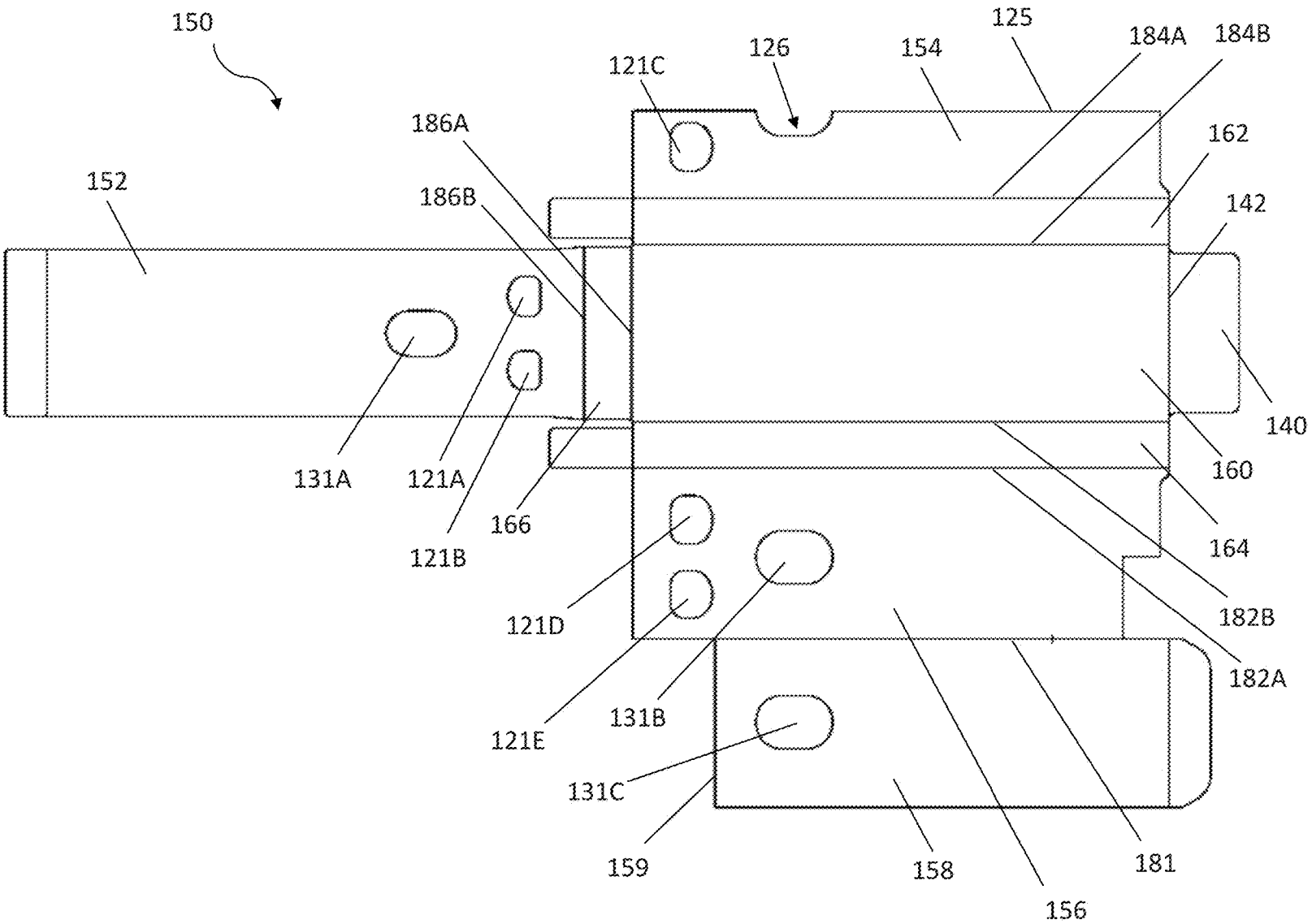
FIG. 2A illustrates a top view of an unconstructed housing component according to the invention.

FIG. 2A illustrates an unconstructed housing component 150. As shown in FIG. 2A, the unconstructed housing component 150 includes a plurality of panels: a first front face panel 152, a second front face panel 154, a third front face panel 156, a fourth front face panel 158, a rear face panel 160, a first side face panel 162, a second side face panel 164, and an end face panel 166.

Figure 5A:
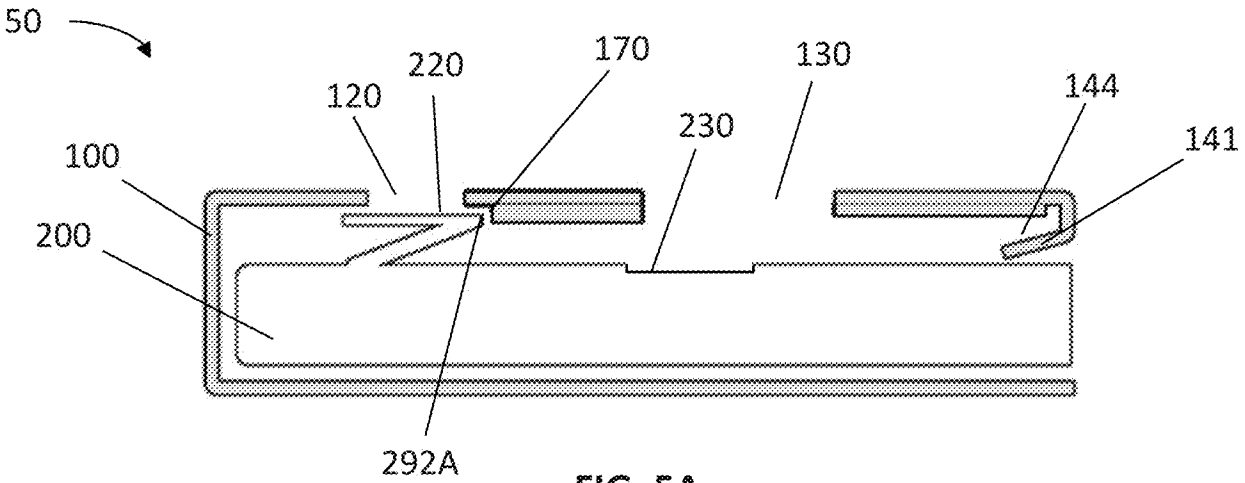
FIG. 5A illustrates a sectional side view of child resistant packaging in a locked configuration according to the invention.

The first front face panel 152 includes first tab openings 121A, 121B and a first guide opening 131A. The second front face panel 154 includes a second tab opening 121C. The second front face panel 154 also includes a removed portion 126 located along perimeter edge 125. The third front face panel 156 includes third tab openings 121D, 121E and a second guide opening 131B. The fourth front face panel 158 includes a third guide opening 131C and a panel edge 159. The rear face panel 160 includes a lock flap panel 140. The lock flap panel 140 is folded along panel border 142 toward the rear face panel 160. The folded lock flap panel 140 forms a receptacle 144 (see FIG. 5A).

The panels of the unconstructed housing component 150 are folded to form the constructed housing component 100 shown in FIG. 28. As shown in FIG. 2A, fourth front face panel 158 is folded inwardly along fold line 181 to abut third front face panel 156 so that third guide opening 131C and second guide opening 131B are aligned. Second side face panel 164 is folded along fold lines 182A, 1828 so that panels 156, 158 are positioned a distance from rear face panel 160. Second front face panel 154 is folded along fold lines 184A, 184 B so that second front face panel 154 is positioned atop panels 156, 158. Once folded, second tab opening 121C and third tab opening 121E are aligned. Removed portion 126 is aligned with a portion of guide openings 131B, 131C. Lastly, end face panel 166 is folded inwardly along fold lines 186A, 186B so that first front face panel 152 is positioned over panels 154, 156, 158 such that first guide opening 131A is aligned with removed portion 126, third guide opening 131C, and second guide opening 131B. Panels positioned over or layered on top of other panels provides strength and durability to the packaging. Once constructed with adhesion applied, the panels form an interior space 116 as shown in FIG. 2B.

Turning to FIG. 2B, housing component 100 includes a front face 102, a rear face 104, a first side face 106, a second side face 108, and an end face 110. Housing component 100 includes an open end 112 leading to an interior space 116 for receiving the insert component 200.

Figure 7:
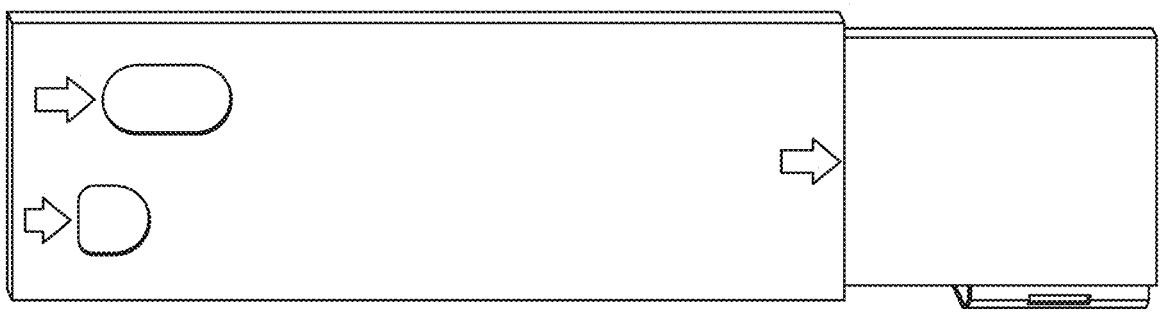
FIG. 7 illustrates a perspective view of the housing component and the insert component in an unlocked configuration according to another embodiment of the invention.

Tab aperture elements 120 are positioned on the front face 102 near the end face 110. Each tab aperture element 120A, 120B is defined by a straight edge border 122 and a curved edge border 124. Although the embodiment shown in FIG. 2B illustrates two tab aperture elements, the packaging may include only one tab aperture element as shown in FIG. 7.

Also located on the front face 102 in proximity to the tab aperture elements 120A, 120B is a guide aperture element 130. Guide aperture element 130 is defined by a continuous connected boundary 133. More specifically, as shown in FIG. 2B, the continuous connected boundary 133 is defined by straight edge boundaries 132A, 132B and curve edge boundaries 134A, 134B. A lock flap element 141 (FIGS. 5A-5D) formed by lock flap panel 140 (FIG. 2A) is located at the open end 112 by the folding of lock flap panel 140 along panel border 142 (FIG. 2A). As shown in FIGS. 5A-5D, the lock flap element 141 forms a receptacle 144. Within the interior space 116, a lip element 170 is located between the tab aperture elements 120 and guide aperture element 130. Lip element 170 is formed by panel edge 159 (FIG. 2A).

Figure 3A:
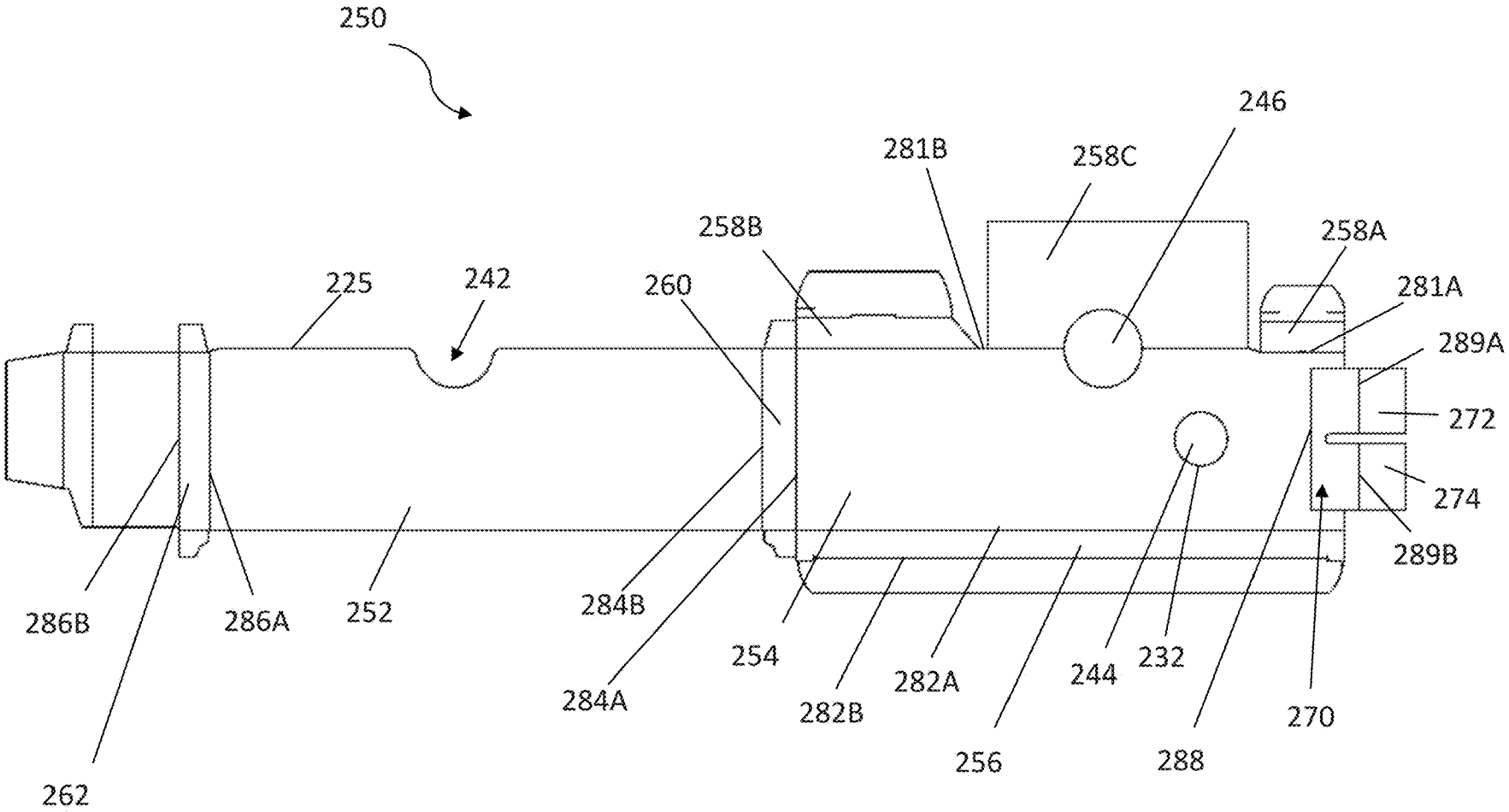
FIG. 3A illustrates a top view of an unconstructed insert component according to the invention.

FIG. 3A illustrates an unconstructed insert component 250. As shown in FIG. 3A, the unconstructed insert component 250 includes a plurality of insert panels: a top surface panel 252, a bottom surface face panel 254, a first side surface panel 256, three second side surface panels 258A, 2586, 258C, an end surface panel 260, a front surface panel 262, and a tab panel 270.

The top surface panel 252 includes removed portion 242 along perimeter edge 225. The bottom surface face panel 254 includes a guide opening 244. The guide opening 244 is defined by an edge border 232. Although the guide opening 244 is shown as a circle in FIG. 3A, any shape is contemplated. Opening 246 is positioned so that portions of opening 246 reside on bottom surface face panel 254 and side surface panel 258C. Tab panel 270 includes a first tab portion 272 and a second tab portion 274. Although the embodiment as shown illustrates the first tab portion 272 independent from the second tab portion 274, it is contemplated that the first tab portion 272 and the second tab portion 274 may be one in the same.

The panels of the unconstructed insert component 250 are folded to form the constructed insert component 200 shown in FIG. 36. As shown in FIG. 3A, second side surface panel 258C is folded inwardly along fold line 281B so that opening 246 forms a feature similar, if not identical, to removed portion 242. Once folded, second side surface panel 258C abuts and covers guide opening 244. Side surface panels 258A and 258B are folded along fold lines 281A and 281B, respectively. First side surface panel 256 is folded inwardly along fold lines 282A, 282B. End surface panel 260 is folded along fold lines 284A, 284B so that top surface panel 252 is positioned a distance from bottom surface panel 254. Then, front surface panel 262 is folded along fold lines 286A, 286B. Tab panel 270 is folded inwardly to bottom surface panel 254 along fold line 288. Furthermore, first tab portion 272 and second tab portion 274 are folded outward from bottom surface panel 254 along fold lines 289A, 289B, respectively. In this embodiment of the invention, fold line 288 is parallel to 289A, 289B. Once constructed with adhesion applied, the panels form a cavity 218 as shown in FIG. 3B for storing product.

Figure 3B:
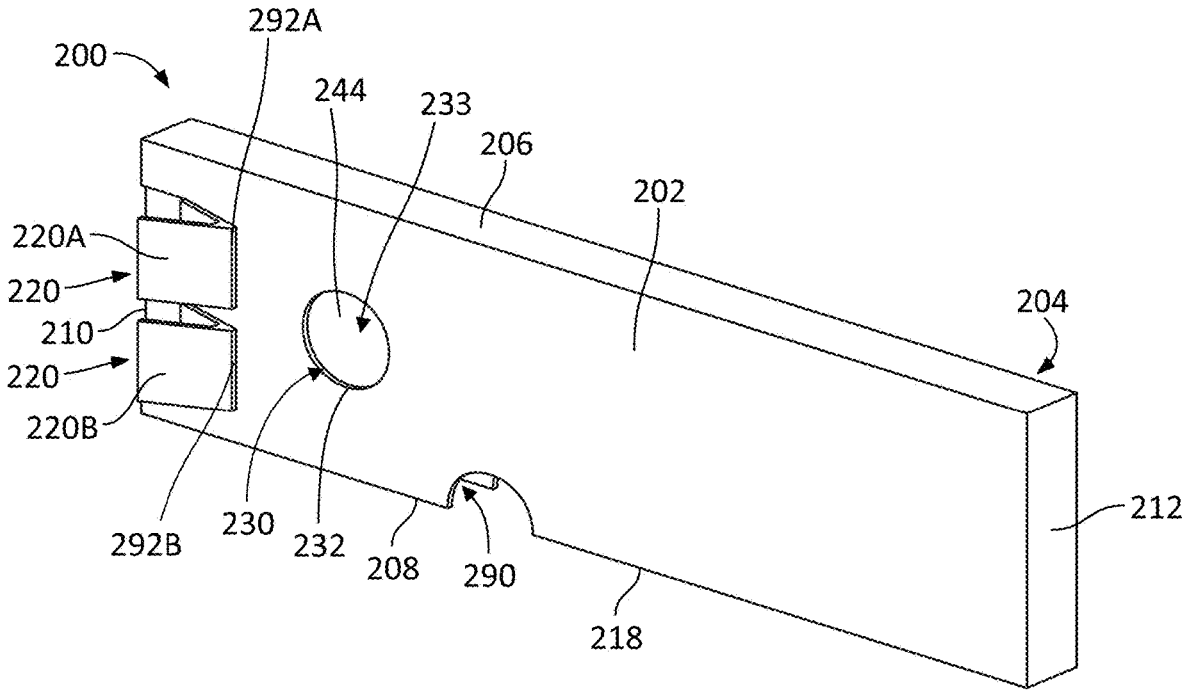
FIG. 3B illustrates a perspective view of a constructed insert component according to the invention.

As shown in FIG. 3B, insert component 200 includes a top surface 202, a bottom surface 204, a first side surface 206, a second side surface 208, an end surface 210, and a front surface 212. Insert component 200 includes a cavity 218 for receiving a product.

As shown in FIG. 3B, tab elements 220 are positioned on the top surface 202 near end surface 210 and are constructed from a tab panel 270 and a tab portion 272 (FIG. 3A). Once constructed, tab elements 220 include folds 292. Each fold 292A, 292B formed at fold lines 289A, 289B (FIG. 3A) are oriented parallel to end surface 210 and front surface 212, or perpendicular to first side surface 206 and second side surface 208. Each tab element 220A, 220B is a folded protrusion providing resiliency, i.e., tab elements 220 possesses a spring-like action. As shown, tab elements 220 are illustrated as a rectangular protrusion, however any shaped protrusion is contemplated. Also located on the top surface 202 in proximity to the tab elements 220 is a guide recess element 230. The guide recess element 230 is defined by opening 244 including edge border 232 and a base element 233. The base element 233 is formed from a portion of the second side surface panel 258C (FIG. 3A) that is exposed through the opening 244. Although the guide recess element 230, particularly the edge border 232, is shown as circular shaped, any shape is contemplated. Insert component 200 also includes indicator elements 290 located on each of the top surface 202 and the bottom surface 204. The indicator elements 290 are semi-circular shaped and assist with removing the product from the cavity 218.

Figure 4:
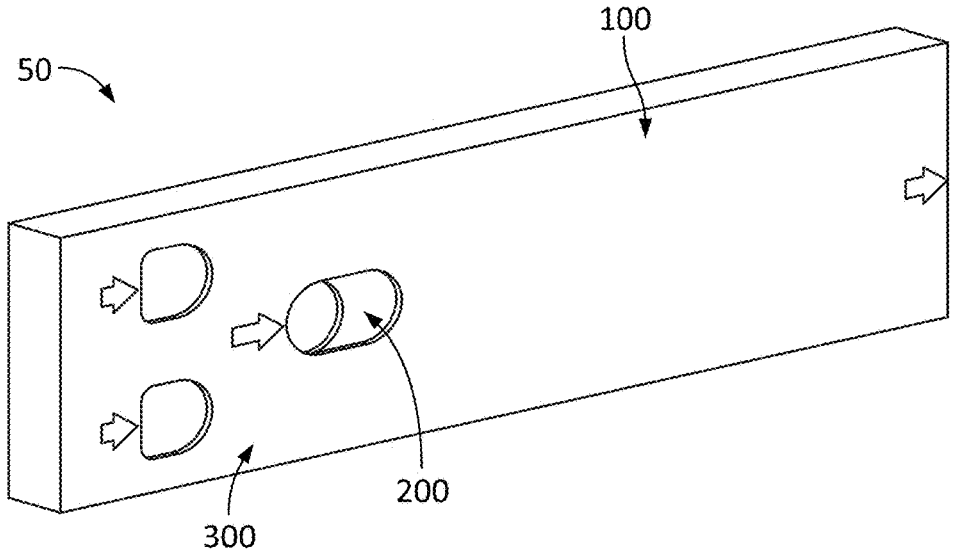
FIG. 4 illustrates a perspective view of the housing component and the insert component in a locked configuration according to the invention.
Figure 5B:
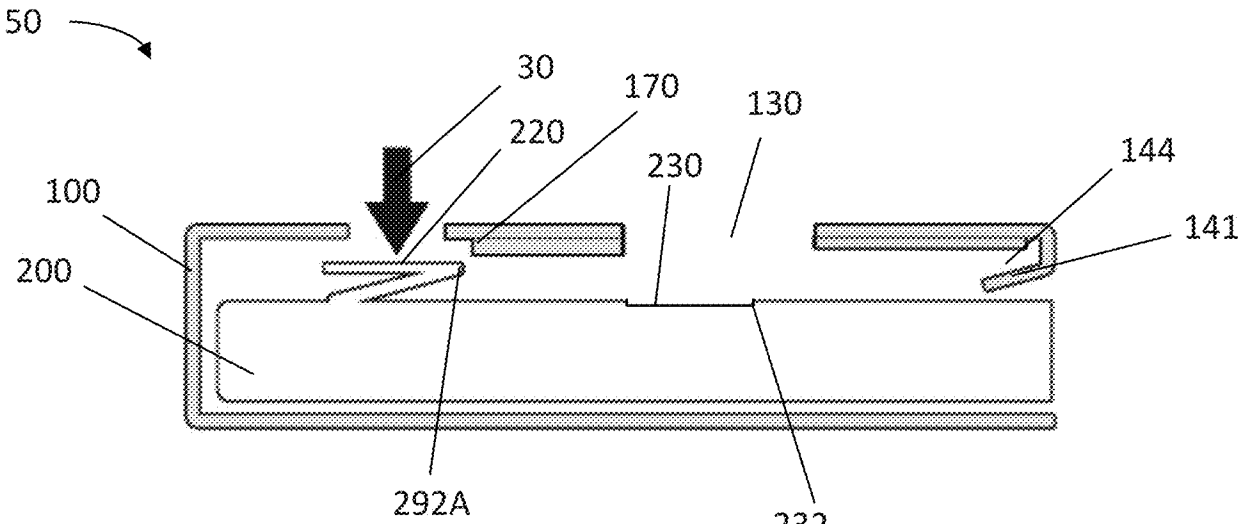
FIG. 5B illustrates a sectional side view of child resistant packaging in an unlocked configuration according to the invention.
Figure 5C:
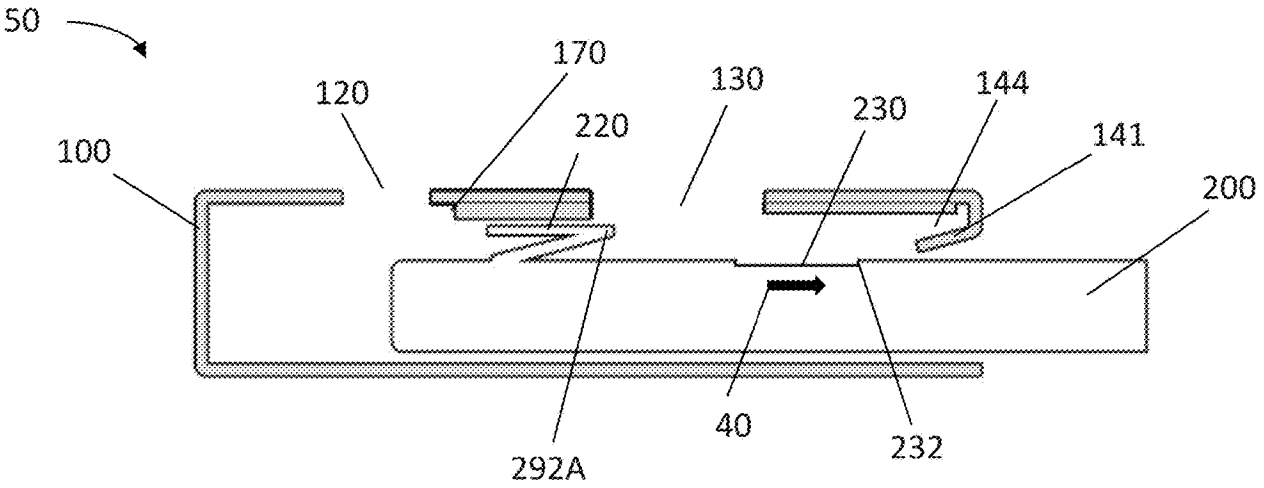
FIG. 5C illustrates a sectional side view of the child resistant packaging in an unlocked configuration according to the invention.

FIG. 4 illustrates a perspective view of the packaging 50 including housing component 100 and an insert component 200 with the locking mechanism 300 in a locked configuration according to the invention. As seen in the sectional side view of FIG. 5A, the tab elements 220 abut the lip element 170 obstructing movement of the insert component 200 from the interior space 116 (FIG. 2B) of the housing component 100. More specifically, folds 292A, 292B formed at fold lines 289A, 289B of tab portions 272, 274 (FIG. 3A), respectively, abut panel edge 159 (FIG. 2A). As shown in FIG. 5B, vertical pressure 30 is applied to the tab elements 220—e.g., pressure is applied simultaneously to tab panel 270 and tab portion 272 and/or tab panel 270 and tab portion 274—such that the tab elements 220 are released, specifically folds 292A, 292B are free from the lip element 170 by way of the tab aperture elements 120 in order to un-obstruct movement of the insert component 200 from the housing component 100. To remove a portion of the insert component 200 from the housing component 100, lateral pressure 40 is applied to the edge border 232 of the guide recess element 230 as shown in FIG. 5C. With a portion of the insert component 200 removed from the housing component 100, a user may grasp this portion—such as by top surface 202 and bottom surface 204—near the front surface 212 to further remove the insert component 200 from the housing component 100.

Figure 5D:
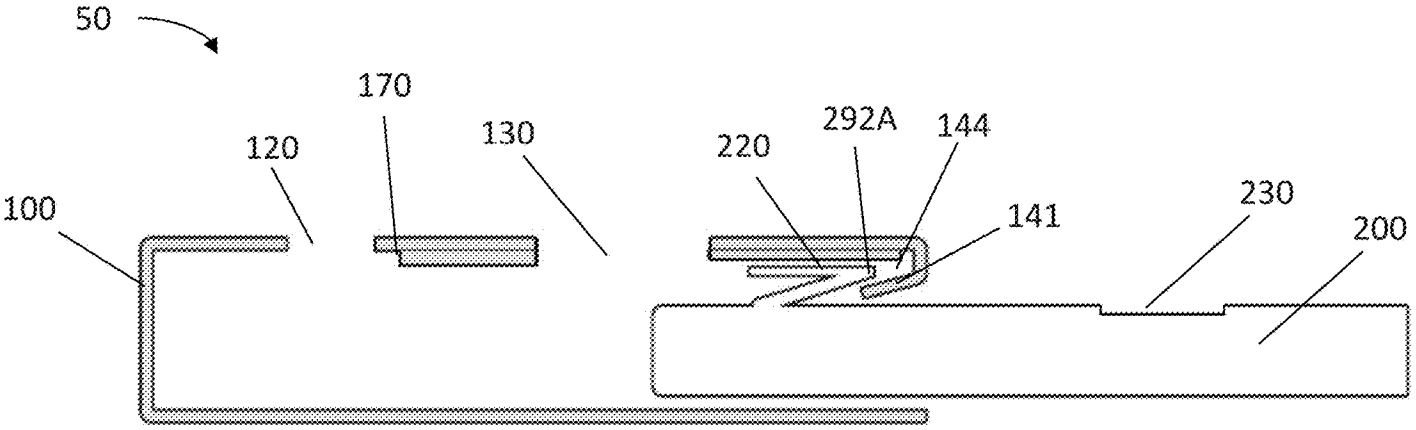
FIG. 5D illustrates a sectional side view of the child resistant packaging in an unlocked configuration according to the invention.
Figure 6:
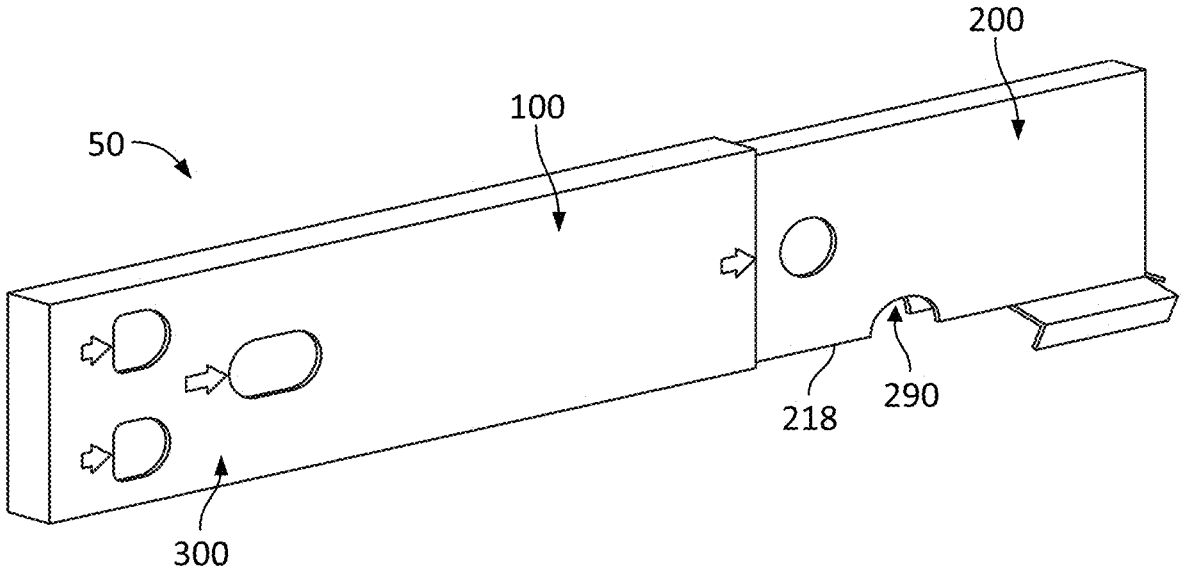
FIG. 6 illustrates a perspective view of the housing component assembled with the insert component in an unlocked configuration according to the invention.

As shown in FIG. 5D, lock flap element 141 forms a receptacle 144 for receiving the tab elements 220. The receptacle 144 receives tab elements 220 to prevent the insert component 200 from separating from the housing component 100 while the insert component 200 is removed from the housing component 100. FIG. 6 illustrates a perspective view of the packaging 50 in an unlocked configuration according to the invention. Indicator elements 290 located on the insert component 200 assist with removing product from the cavity 218.

While this disclosure is susceptible to various modifications and alternative forms, specific exemplary embodiments thereof have been shown by way of example in the drawings and have herein been described in detail. It should be understood, however, that there is no intent to limit the disclosure to the particular embodiments disclosed, but on the contrary, the intention is to cover all modifications, equivalents, and alternatives falling within the scope of the disclosure as defined by the appended claims.

The invention claimed is:

1. A child resistant packaging comprising:

a housing component comprising housing panels folded to form an interior space, the housing component including one or more tab aperture elements, a guide aperture element, and a lip element, the guide aperture element defined by a continuous connected boundary;

an insert component comprising insert panels folded to form a cavity configured to store a product, the insert component including one or more tab elements and a guide recess element, the guide recess element constructed from a first insert panel and a second insert panel, wherein the first insert panel includes an opening defined by an edge border, the first insert panel and the second insert panel folded to cover one another such that a base element comprising a portion of the second insert panel is exposed through the opening of the first insert panel, the insert component configured to slideably interact with the interior space of the housing component between a locked configuration and an unlocked configuration, in the locked configuration, the one or more tab elements abut a panel edge of the lip element of the housing component, the locked configuration obstructing movement of the insert component from the interior space of the housing component, and a portion of both the base element and the edge border of the guide recess element accessible through the guide aperture element, in the unlocked configuration, the one or more tab elements released from the panel edge of the lip element of the housing component via the one or more tab aperture elements, the unlocked configuration un-obstructing movement of the insert component from the interior space of the housing component.

2. The child resistant packaging according to claim 1, wherein the housing component further comprises a lock flap element, the lock flap element configured to contain a portion of the one or more tab elements preventing the insert component from being completely removed from the housing component.

3. The child resistant packaging according to claim 1, wherein the one or more tab aperture elements are each defined by a straight edge border and a curved edge border.

4. The child resistant packaging according to claim 1, the guide aperture element is defined by a first straight edge boundary, a second straight edge boundary, a first curve edge boundary and a second curve edge boundary.

5. The child resistant packaging according to claim 1, wherein the one or more tab aperture elements and the guide aperture element are positioned on a front face of the housing component.

6. The child resistant packaging according to claim 1, wherein the guide recess element is defined by an edge border and a base element.

7. The child resistant packaging according to claim 6, wherein the guide recess element is circular shaped.

8. The child resistant packaging according to claim 1, wherein the one or more tab elements are rectangular shaped.

9. A method for operating packaging, the method comprising the steps of:

placing the packaging on a surface, wherein the packaging includes a housing component with an interior space containing an insert component;

applying a vertical pressure to one or more tab elements positioned on the insert component to release the one or more tab elements from a lip element, wherein the one or more tab elements are accessible through one or more first aperture elements of the housing component;

exposing outside the housing component a portion of the insert component by applying a lateral pressure to a guide recess element positioned on the insert component, wherein the guide recess element comprises an opening defined by an edge border and a portion of the insert component exposed through the opening, wherein a portion of the edge border of the guide recess element is accessible through a guide aperture element of the housing component, the guide aperture element defined by a continuous connected boundary;

releasing the pressure to the one or more tab elements; and pulling the exposed portion of the insert component to remove the remaining portion of the insert component from the interior space of the housing component.

10. The method for operating packaging according to claim 9 further comprising the step of:

pushing the exposed portion of the insert component to move the insert component into the interior space of the housing component.

11. The child resistant packaging according to claim 1, wherein the insert component further includes indicator elements positioned on a top surface and a bottom surface of the insert component.

12. The child resistant packaging according to claim 11, wherein each indicator element is semi-circular shaped.

13. The child resistant packaging according to claim 1, wherein the housing component is made from a paper-based material.

14. The child resistant packaging according to claim 13, wherein the paper-based material is laminated.

15. The child resistant packaging according to claim 1, wherein the insert component is made from a laminated paper-based material.

16. The child resistant packaging according to claim 1, wherein the packaging is a rectangular shaped configuration.

17. The child resistant packaging according to claim 1, wherein the guide recess element is circular shaped.

18. The child resistant packaging according to claim 1, wherein the continuous connected boundary comprises a straight edge.

19. The child resistant packaging according to claim 1, wherein the continuous connected boundary comprises a curved edge.

20. The child resistant packaging according to claim 1, wherein the guide recess element is square shaped.

* * * * *